US007976357B1

(12) United States Patent
Riley

(10) Patent No.: US 7,976,357 B1
(45) Date of Patent: Jul. 12, 2011

(54) BRA SAVER DEVICE

(76) Inventor: Beverly A Riley, Gosnell, AR (US)

( * ) Notice: Subject to any disclaimer, the term of this patent is extended or adjusted under 35 U.S.C. 154(b) by 1185 days.

(21) Appl. No.: 11/706,898

(22) Filed: Feb. 13, 2007

(51) Int. Cl.
*A41C 3/00* (2006.01)

(52) U.S. Cl. ..... 450/57; 2/260; 2/267

(58) Field of Classification Search ..... 2/267, 268, 2/336, 338, 244, 246, 46, 53–57, 455, 459–461, 2/174, 171; 450/36–38, 54–58, 1; 132/63.1, 132/101, 107–110, 275–284; 63/1.15, 43; 24/592.1, 53.1, 593.11, 114, 163 FC, 578.1, 24/578.14, 903
See application file for complete search history.

(56) References Cited

U.S. PATENT DOCUMENTS

| | | | | | |
|---|---|---|---|---|---|
| 722,617 | A | * | 3/1903 | Peet | 24/357 |
| 887,687 | A | * | 5/1908 | McConn | 2/56 |
| 919,299 | A | * | 4/1909 | Allport | 2/56 |
| 2,573,346 | A | * | 10/1951 | Madsen | 2/55 |
| 2,793,644 | A | * | 5/1957 | Todfield | 132/277 |
| 3,521,642 | A | * | 7/1970 | Jordan | 450/55 |
| 3,568,681 | A | * | 3/1971 | Comollo | 450/54 |
| 3,605,753 | A | | 9/1971 | Schwartz | |
| 3,777,763 | A | | 12/1973 | Schwartz | |
| 4,699,144 | A | * | 10/1987 | Sherwood | 450/54 |
| 4,770,650 | A | | 9/1988 | Rowell | |
| 5,395,280 | A | * | 3/1995 | Greenberg | 450/54 |
| 5,690,537 | A | * | 11/1997 | Kalmus | 450/57 |
| 5,730,641 | A | | 3/1998 | Brown | |
| 5,749,767 | A | | 5/1998 | Arceo | |
| 5,830,040 | A | | 11/1998 | Morgan et al. | |
| 5,940,888 | A | * | 8/1999 | Sher | 2/267 |
| 6,406,353 | B1 | * | 6/2002 | Harper | 450/57 |
| 6,435,939 | B1 | | 8/2002 | Lin | |
| 6,446,268 | B1 | | 9/2002 | Lazarian | |
| 6,682,395 | B2 | | 1/2004 | Falla et al. | |
| 6,780,080 | B2 | | 8/2004 | Horta et al. | |
| 6,896,580 | B2 | | 5/2005 | Falla et al. | |

OTHER PUBLICATIONS

Helen of Troy, Vidal Sasson & Nandi 2006 Catalog-brush and comb assessories@www.helenoftroyusa.com, Apr. 20, 2006, p. 5 (Classic Barrette Collection), El Paso, Texas USA.
Product Name "Vidal Sasson—Sure Grip Clix", listed in catalog as item Nos. VS11358—large clix comb and VS11356—medium clix comb.

* cited by examiner

*Primary Examiner* — Gloria Hale

(57) ABSTRACT

A bra saver device made for underwire and non-underwire bras to provide protection to the wearer from sudden exposure to underwires and to provide comfort between the wearer of a bra from friction caused by movement of a bra during normal use. The present invention easily attaches to the edge of a bra by opening the clip to the present invention and placing it over the bra where ever an underwire has become exposed and then closing the clip to securely attach the present invention to a bra. The present invention can also be attached to any section of the bra at the edge along the bra at the top or the bottom, front or back where the wearer of the bra experiences discomfort.

27 Claims, 3 Drawing Sheets

BRA SAVER DEVICE

CROSS REFERENCE TO RELATED APPLICATIONS not applicable

FEDERALLY SPONSORED RESEARCH not applicable

SEQUENCE LISTING OF PROGRAM not applicable

BACKGROUND OF INVENTION

1. Field of Invention

This invention relates generally to undergarment protection devices for protection from bodily harm from underwire and non-underwire bras, specifically to a cushioned structure attached to a wire clip that prevents exposure of underwires to the skin of the user where the encasing for an underwire is torn or continuously rubs or presses against the skin of the user causing punctures or bruises to the wearer's skin. The invention also relates to the protection of the skin from any bra in the front, sides or back where friction or movement of the bra causes bruises to the wearer from constant rubbing against the body.

2. Prior Art

The undergarment industry provides consumers with an enormous selection of bras to be worn under clothing to support the breasts. The underwire bra is one of the most popular bras on the market because of its unique designs and its ability to lift up the breast in low-cut and covered blouses and other outer wear clothing.

Originally, these underwire bras were designed to provide the user with the appearance of an uplifted set of breast. However, underwire bras can be very uncomfortable after continued use and washing because the underwires protrude out from the bras over time and bruise or puncture the wearer. Even new underwire bras that have not been worn excessively tend to do the same. In some cases where the underwire does not surface, the casing for the underwire presses against the skin and rubs and bruises the skin during normal wear and movement by the user.

To address this underwire problem and the friction caused by movement in bras, inventors have created many types of underwire protection devices that cover the tips of the underwire so that if the underwire becomes exposed, it will not puncture or cause harm to the skin of the wearer. Inventors have also created devices that help restrict the movement of the bras. Lazarian's U.S. Pat. No. 6,466,268 addressed the sliding of a bra by inventing a garment support device which has a slip-resistant material impregnated into a support material, wherein selective placement of the device onto a garment decreases the friction between garment and the wearer's skin without deforming the contact surface, thus helping to prevent the garment from sliding relative to the wearer's skin. Although this device helps to keep the bra from sliding or moving excessively, it does not address the problem of protecting the wearer from the underwire exposure caused by the tearing of fabric. Other prior art inventors of U.S. Pat. Nos. 6,780,080; 4,770,650; 3,777,763; 5,830,040 and 3,605,753, invented devices that attach to the tips of the underwires to prevent damage to the user in the event of unexpected exposure; yet, these inventors did not necessarily address the bulkiness of the casing of these underwire bras that rub against the skin and cause bruises to the wearer. Other inventors of U.S. Pat. Nos. 5,730,641 and 5,749,767 changed the shapes of the ends of the underwire tips to prevent the end of the tip from becoming exposed from tearing or damage to the casing of the underwire bra. Furthermore, inventors of U.S. Pat. Nos. 6,435,939; 6,682,395 and 6,896,580 invented underwires that completely covered and protected the underwires with silicon rubber or latex (Lin), gelatinous material (Falla et al.) and gelatinous strips (Falla et al.), respectively. These inventions by Lin and Falla et al. still provide additional layers of fabric casings to cover the underwires that are bulky and that have still resulted in bruising many users due to friction. Lastly, each of these inventors did address a specific problem for the wearer but the underwire bra continues to be uncomfortable for many users even when the underwire is not exposed. Other inventors have also patented many other solutions to underwire exposure as cited in the patent applications of the aforementioned inventors and patents.

OBJECTS AND ADVANTAGES

Accordingly, several objects and advantages of the invention are comfort, safety, appearance and use.

It is an object of the present invention to provide the user with added protection from exposure to the underwire. An exposed underwire can puncture or bruise the skin of the user. The present invention will allow the user to reposition the underwire and place the present invention over the exposed underwire area to prevent the underwire from harming the wearer.

It is another object of the present invention to prevent an underwire from moving and eventually becoming exposed. Because the wearers of bras usually move constantly, this causes underwires to slide and twist in their casing. Eventually, the casing to the underwire tares and wears over time. By securing the present invention over the underwire casing, the encased underwire can be stabilized and prevented from movement to prolong the life of the bra.

It is still another object of the present invention to preserve and continue to wear the underwire bra in case of the unlikely event of underwire exposure. Many users of underwire bras do not experience the opportunity of repeated use of their underwire bra purchases. Many underwire bras are decorative, come as part of a set, and are expensive. In many cases, the exposure of the underwire causes the bra to not be worn or to be discarded by the wearer. The present invention allows the user to save the bra, secure the under wire, and have a longer use of the product. Having to discard a bra that is otherwise in good condition is disappointing and wasteful for the purchasers of such bras.

It is a further object of the present invention to provide comfort to the user from the continued pressure or friction near the underwire casing where underwires are inserted and encased in a bra. The cushioning structure of the present invention for underwire bras provides the wearer with enough space between the bra and the skin of the user, which prevents direct contact of the skin with exposed underwires or irritating, underwire casing. The user will only feel cushion when wearing the present invention over the underwire casing instead of the rubbing or pressing against the skin that usually occurs during use. The present invention, when used properly, is stable until removed and can minimize the sliding and movement of the bra during use. The present invention will also provide protection from non-underwire bras that cause bruising from rubbing or friction.

It is still another object of the present invention to provide a stable clip that attaches to the underwire bra over the underwire casing or other bra structures that rub and cause friction between the bra and the wearer.

It is still a further object of the present invention to attach to a bra securely and to be easy to use. The clip of present invention opens and closes with ease.

These and other objects and advantages of the present invention are achieved by the front portion of the clip which is covered with fabric made of lace or ribbon and smooth lingerie fabric that is soft to the skin and not irritating or scratchy on the outer surface. This fabric and lace or ribbon is commonly used to make undergarments for lingerie garments. The front portion of the clip of the invention looks sleek, dainty and is very small in appearance. This makes it almost unnoticeable once in place. The wire clip, once secured in place, lies in a curved position and becomes seemingly one with the bra and it does not protrude or show through clothing. The fabric/lace or ribbon covering of the wire clip of the present invention also prevents the clip from damaging the outer clothing. The fabric covering of the clip of the present invention can be manufactured using numerous colors and will be widely available in the basic bra colors such as white, black or beige.

In the second embodiment of the present invention which is the back side of the present invention, there is provided 5 layers and the base of the attaching mechanism (clip). These layers insure that the base will not become exposed and that added cushion will be provided to the user, herein referred to as a cushioning structure. The first layer is strong elastic sandwiching the base of the clip. This elastic is sewn together to secure the base at the bottom, on the sides, and within the middle of the base of the clip. Additional hand stitches are made to further secure the base to the elastic at the top and in the middle of the base of the clip. The elastic is covered with fabric before it is then covered with foam housed between two pieces of fabric (lingerie) and sewn again to the first layer of the elastic casing of the clip. Another layer of lace covers the fabric that covers the foam that covers the elastic that covers the base of the clip. All these layers insure that the base of the clip will not be exposed; the clip will not damage the bra; the cushioning structure will be comfortable to the user and provide padding for the front portion of the clip to protect the user and the bra. These layers are strong but not bulky and cannot be noticed or visible when the present invention is in place. Furthermore, the outer layer encasing the base of the clip will match the color of the front outer portion clip and will be available in basic and many other colors for the wearer to purchase.

Another advantage of the present invention is that it is extremely small, easy to manufacture and lightweight. Its cost to produce will be low and the price to the consumer will be inexpensive, considering the benefits obtained from its usage.

A final advantage and important aspect of the present invention is that it is washable and reusable. It will be easy to clean and maintain by the user.

The present invention is novel in that no previous inventors have addressed the underwire discomfort or safety from this perspective. Other inventors have created cushioning structures to address the safety of underwire bras by covering the underwire with materials, enclosing the underwire in layers of materials or changing the shape of the underwire. Some inventors have added materials or additional cushioning materials to the tips of the underwires to protect the user. The present invention supports the fact that the use, washing, and continual movement in bras will not provide protection from underwire and other bras from sudden or unexpected harm. The present invention acknowledges that underwires will continue to become exposed or the covering or casing of underwires in bras will continue to cause friction between the bra and the wearer's skin. The present invention approaches the underwire exposure from the outside of the bra instead of from the inside by providing the user with additional protection that attaches from the outside exactly where the problem may occur in a discrete and inexpensive way.

SUMMARY OF THE INVENTION

In accordance with the present invention, the bra saver device comprises a clip enclosed in cushioned foam material and elastic, covered in fabric and lace or ribbon that attaches to a bra for protection from underwires in bras and/or friction that causes bruises from underwire bra casings or non-underwire bras. It is small, inexpensive to make, available in many colors and shapes and will not harm the user or the bra. The present invention is easy to use and maintain for the consumer.

SUMMARY

In accordance with the present invention a bra saver device comprising a cushioning structure sandwiching a wire clip that attaches to a bra made of multiple layers of fabric and foam.

DRAWINGS—FIGURES

REFERENCE MATERIALS

Figure 1:
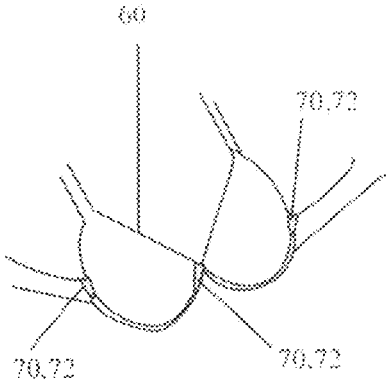
FIG. 1 is a perspective front view of the present invention and its intended use with a bra.

10 Foam
20 Elastic covering
21 Elastic back
22 Elastic front with pockets
23 Horizontal stitches in elastic to make 3 pockets
30 Fabric that covers base elastic, foam and top portion of clip
40 Lace that covers the fabric that covers the base of clip
50 Lace or ribbon that covers the fabric that covers front portion of clip
60 Bra for illustration
70 Wire clip
71 Bottom side of wire clip (also referred to as "clip", clip base or botton portion of clip)
72 Top side of wire clip (also referred to as "clip" or front/top portion of clip)
73 Wire clip prongs
74 Opening of the clip that surrounds the bra casing or the edge of a bra

DETAILED DESCRIPTION OF THE INVENTION—PREFERRED EMBODIMENT

Figure 3:
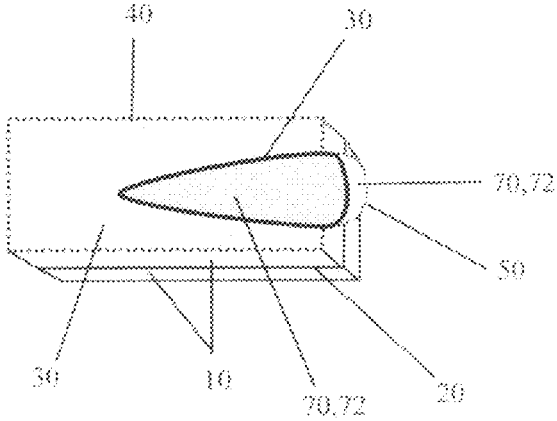
FIG. 3 is a perspective front-side view showing the present invention and its outer front layers and other layers as identified in the reference section.
Figure 4:
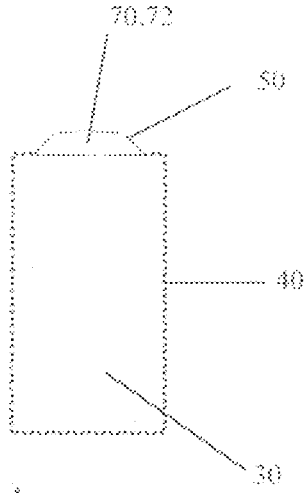
FIG. 4 is a perspective back-side view showing the present invention and its outer back layers.
Figure 5:
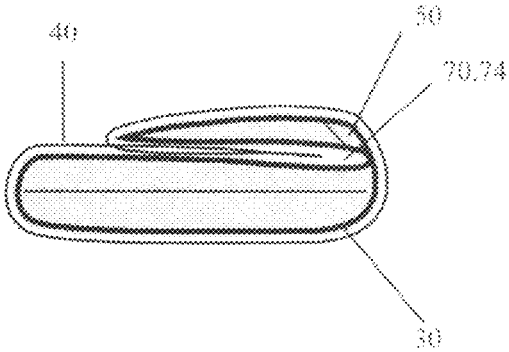
FIG. 5 is a perspective right-side view showing the present invention in the closed position and its outer layers.
Figure 6:
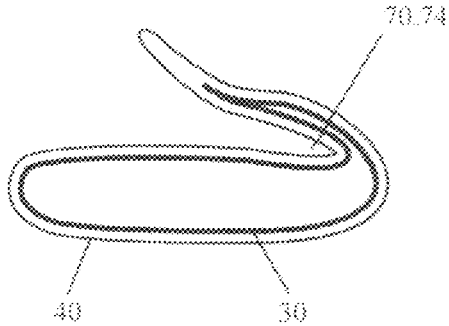
FIG. 6 is a perspective right-side view showing the present invention in the open position and its outer layers.
Figure 7:
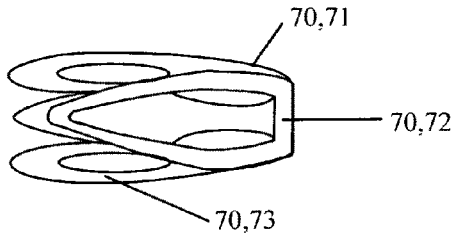
FIG. 7 is a perspective front-side view of the wire clip used as a component part of the present invention.
Figure 8:
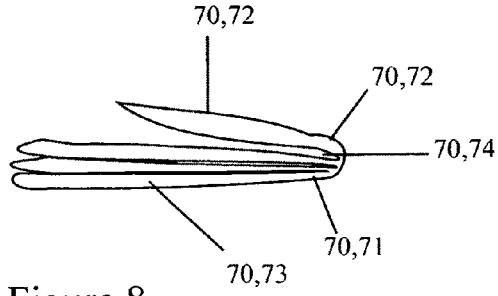
FIG. 8 is a perspective right-side view of the wire clip used as a component part of the present invention.
Figure 9:
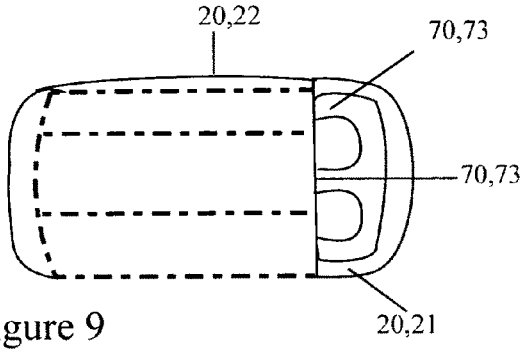
FIG. 9 is a perspective front view of the elastic covering and the wire clip, used to sandwich and secure the clip of FIG. 7 in the present invention in the secured position depicting where the base of the clip is inserted into the elastic.
Figure 10:
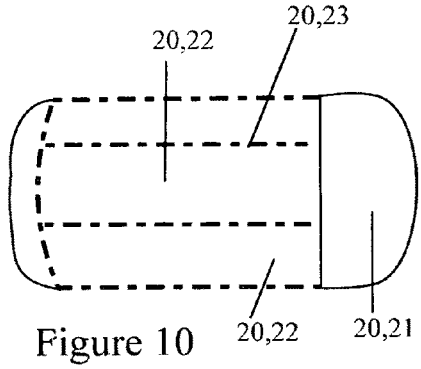
FIG. 10 is a perspective front view of the elastic covering used to sandwich and secure the wire clip in FIG. 7 before insertion.
Figure 11:
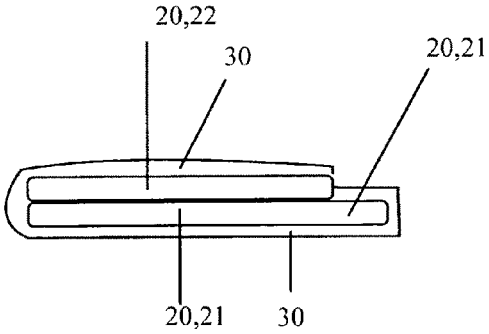
FIG. 11 is a perspective left-side view of the elastic covering of FIG. 10.
Figure 12:
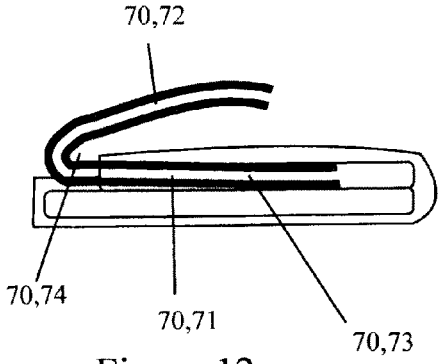
FIG. 12 is a perspective right-side view of FIG. 9 with clip inserted.
Figure 13:
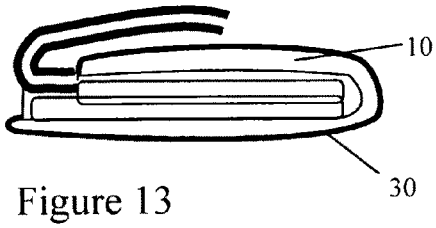
FIG. 13 is a perspective right-side view of the foam covering for the elastic in FIG. 10 and FIG. 11 which covers the wire clip in FIG. 7.
Figure 14:
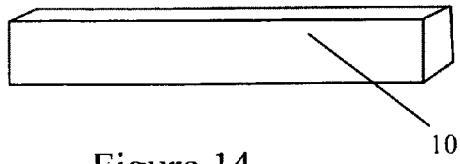
FIG. 14 is a perspective front-side view of the foam used in FIG. 13.
Figure 15:
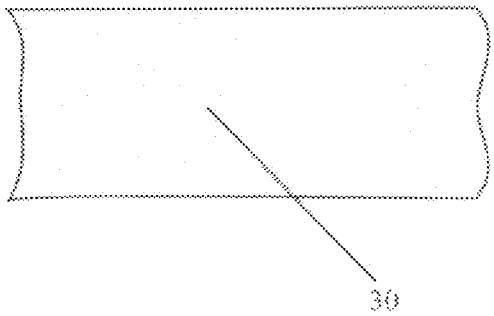
FIG. 15 is a perspective front-side, flat view of the fabric covering the foam in FIG. 14, of the present invention of FIG. 13, FIG. 3, FIG. 4, FIG. 5, and FIG. 6 and also used to cover the elastic in FIG. 10.
Figure 16:
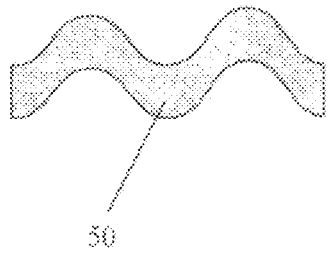
FIG. 16 is a perspective front-side, flat view of the lace or ribbon used to cover the fabric that surrounds the front portion of the clip in FIG. 3, FIG. 4 and FIG. 5.
Figure 17:
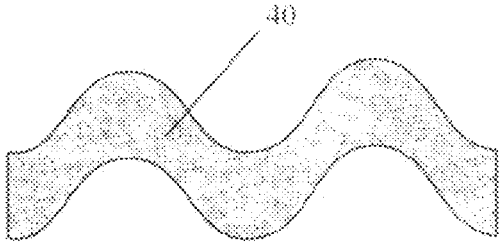
FIG. 17 is a perspective front-side, flat view of the lace or ribbon used to cover the fabric that surrounds the foam in FIG. 14 and the present invention of FIG. 3, FIG. 4, FIG. 5 and FIG. 6.
Figure 18:
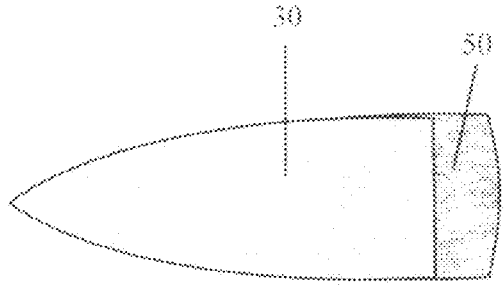
FIG. 18 is a perspective front-side, flat view of the lace or ribbon used to cover the front portion of the wire clip (72) that is attached to the fabric (30) in FIG. 15, covering the wire clip (72).
Figure 19:
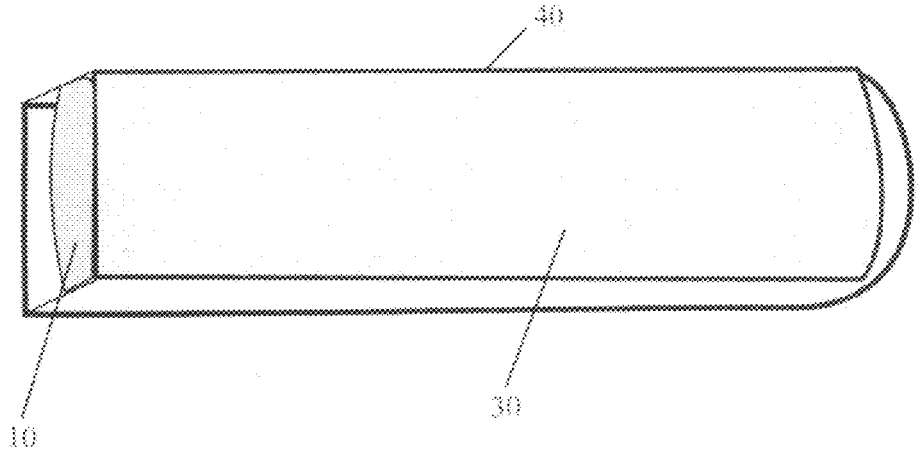
FIG. 19 is a perspective front-side, view of the foam of FIG. 14 inserted into the fabric that covers the covered elastic of FIG. 13.

FIG. 3 is a perspective view from the front-side of the bra saver device in accordance with the invention. The invention is made up of a clip (71 and 72) sandwiched between a piece of elastic (20) and covered with foam (10), fabric (30) and lace (40). First, the elastic is cut to a length sufficient to cover the length of the base of the clip's back side (71) and ¾ of the clip's front side (72) as shown in FIG. 9. The elastic is then covered with a piece of fabric that is cut the length and width of the unfolded elastic plus ⅛ inch on all sides. The fabric is then sewn onto the elastic (20) on the right side after it is folded over the elastic. The open edges of the fabric that is folded over the elastic is sewn ⅛ inch from the open edges enclosing the elastic on all sides. The fabric (30) covered elastic (20) is folded to cover the entire back of the base of the clip (71) and ¾ of the front-side of the base of the clip (72). The sides of the covered elastic are sewn together with ⅛ inch seams from the outer edge to the section where the elastic stops in the front of the base of the clip (72), but does not extend to the end where the clip opens. The bottom end of the covered elastic where the fold occurs is sewn first with ⅛ inch stitches from the bottom end of the elastic and then folded approximately ⅛ inch more to the front from the end where the fold that was sewed first and is sewn again with two stitches 1/16 inches apart approximately ⅛ inch from the end of the second fold as shown in FIG. 9 and FIG. 10. This provides a secure hold for the elastic to keep it from unfolding. The covered elastic is also sewn in horizontal seams (23) to provide pockets for insertion of each prong of the clip base (73). These two horizontal seams (23) are made from one end of the front side of the covered elastic to the other end as shown in FIG. 10. Next, the foam (10) is cut the width of the base of the clip (71 and 72) plus an additional ⅛ inches on each side larger than the base of the clip (71 and 72) and the length of the elastic sufficient to cover the entire outer surface of the covered elastic (20) as shown in FIG. 13. This foam (10) is to be inserted into a piece of sewn fabric (30) and will cover the foam (10) entirely. Then, another piece of fabric (30) is cut double the width of the foam plus ⅛ inch more and the entire length of the foam (10) plus ⅛ inch. This piece of fabric (30) is then folded in half on the wrong side and is horizontally and vertically and sewn together using two 1/16 inch apart seams on the open side of the length of the fabric (30) leaving an opening on the end for insertion of the foam (10) as shown in FIG. 19. After the foam is inserted into the piece of fabric as shown in FIG. 19, this fabric (30) covering the foam (10) is covered in lace fabric also. The lace (40) is cut sufficient to cover the length of the covered foam as shown in FIG. 19, folded and stitched with ⅛ inch seams from the open edges of the lace fabric (40). The base of the clip prongs (73) is inserted into the covered piece of elastic (FIG. 11) as shown in FIG. 12. Once the clip prongs (73) are inserted, the base of the clip is secured again by multiple hand stitches attaching the base of the clip (71) to the covered elastic (FIG. 11) in each open section of the prongs (73) having an open space to allow for stitching as shown in FIG. 9. Additionally, fabric (30) is cut and sewn to cover the top side of the clip (72). The fabric (30) is sewn and a small lace or ribbon border (50) is attached to the end of the fabric (30) long enough to provide an overhang that can be hand stitched to the back side of the covered elastic in FIG. 11 as shown in FIG. 18. The front portion of the clip (72) is inserted into the fabric and lace or ribbon casing as shown in FIG. 5 and FIG. 18. The covered front portion of the clip (72) as shown in FIGS. 3, 4, 5 and 6 is attached to the elastic covered base (FIG. 11) using hand stitches to secure the open end of the fabric and lace or ribbon (30,50) as shown in FIG. 18, to the covered elastic base (FIG. 10). The final stitches are sewn securing the lace and fabric covered foam as shown in FIG. 19. The fabric covered foam (FIG. 19) is placed on top of the covered elastic (FIG. 11) and sewn together with two 1/16 inch apart seams on each side of the fabric to complete the invention as shown in FIGS. 3, 4, 5 and 6. The wire clip (70) used in the present invention is a component part of the present invention. The said clip is currently in patent pending status by another inventor. The purpose of the clip (70) provides a base for the construction of the present invention and cannot be used independently in the present invention to serve the purpose of the present invention.

The present invention having been described with particular reference to the preferred forms thereof; it will be obvious that various changes and modifications may be made without departing from the spirit and scope of the invention as defined herein.

Operation of the Invention

Figure 2:
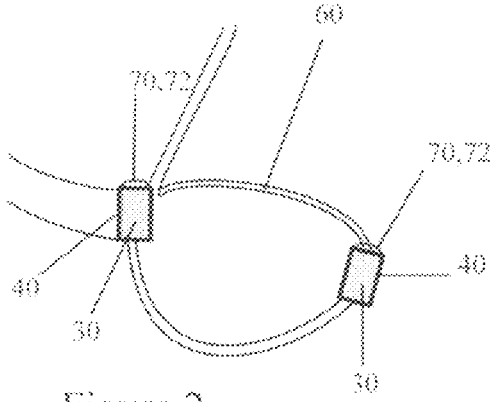
FIG. 2 is a perspective back view of the present invention and its intended use with a bra.

In operation of the present invention, the user must simply open the front clip (72) of the present invention by pushing downward on the front portion of the center of the clip (72). After the clip (70) is open the user may place the opening (74) of the present invention as shown in FIG. 12 and FIG. 13 over the edge of the bra where the underwire casing or covering is located as shown in FIG. 1 and FIG. 2. The present invention is pushed downward after it is placed over the edge of the bra until the material of the bra is sandwiched between the front portion of the clip (72) and the covered base of the clip (71) as shown in FIG. 1 and FIG. 2. The front portion of the clip should be on the outside of the bra and the back side of the present invention as shown in FIG. 4 should be on the inside of the bra as shown in FIG. 2. After the present invention is in this position, the front portion of the clip (72) is pressed downward again. The present invention is then in a secured position. To remove the present invention the user simply presses downward on the front portion of the clip (72) and it opens the bra saver device, which will allow the user to lift upward on the present invention and remove it from the bra. The clip may be used anywhere on the bra where the underwire casing or covering is present or anywhere else on the bra where rubbing or friction causes discomfort to the user. Some other areas of use may be the back of the bra where the closure is located, in the front of a bra when such bras have front closures, or anywhere along the edges of a bra on the top or bottom edge where friction or rubbing occurs. In many cases the wearer of a bra experiences discomfort in a single area instead of multiple locations on the bra. Multiple attachments of the present invention on a single bra is not recommended but is shown in FIG. 1 and FIG. 2 as possible locations where discomfort usually occurs that may require the use of the present invention; however, all potential locations have not be shown.

Alternative Embodiments

There are various possibilities with regard to the cushioning structure of the present invention that can be utilized to mass produce the bra saver device. Some, but not all, alternative embodiments would be to use other alternative strong materials other than elastic to enclose the base of the clip. These other materials could vary from gelatinous materials, soft plastics, leather or other fabrics to secure the base of the clip prior to covering its outer layer. The cushioning embodiment could also be changed from foam to batting, cotton, or multiple layers of soft durable fabric to enclose the base layer that houses or sandwiches the base of the clip. Also, the outer, visible portion of the cushioning structure and/or the outer covering for the front of the clip could be replaced with many other types of fabric covering that may not be limited to nylon, lingerie fabric or lace, including ribbon.

Furthermore, the manner in which the fabric is attached to the clip base or the front clasp of the clip can be altered to include applying adhesives, VELCRO (hook and loop fastener), snaps or other adhesive materials common on the market for attaching products, including but not limited to, zippers, buttons or fabric closures or a combination thereof. Likewise, the front portion of the clip may be covered or uncovered, decorative or plain. Finally, the shape of the entire cushioning structure that sandwiches the base of the clip can vary.

Many different shapes can be achieved by simply changing the layout of the fabric. The present drawings depict the shape of a rectangle. The shape could alternatively be changed to resemble a heart, circle, butterfly, fruit or any other shape or size that may be desirable to the consumer. The clip could alternatively be made of a material other than metal. Other clipping mechanisms could be used such as, but not limited to, hard plastics or bendable wire stays that can be secured and covered to function similar to the present invention or bra saver device.

To conclude, there can be many variations to the materials used to mass produce the same result of the present invention which is to provide a cushioning structure that attaches to a bra to stabilize an exposed underwire and provide added protection to the skin from underwires and/or the underwire casing in underwire bras or non-underwire bras that bruise the skin during normal wear. The use of this type of device is novel in that no other inventors have approached the problem of bra discomfort is this manner. The concept of covering the areas that subject wearer to pain or discomfort when wearing both underwire and non-underwire bras is the result of the present invention. Thus, the present invention offers numerous opportunities to construct and design a device that achieves this result that appeals to the consumer's tastes in color, appearance, feel and degrees of comfort and use.

CONCLUSION, RAMIFICATIONS, AND SCOPE

Accordingly, the reader will see that the bra saver device can also be used to protect the bra to which it is attached from being damaged by securing the underwire casing. The present invention also protects the user from sudden or accidental exposure of the underwire from its bra casing. The bra saver device will also provide added protection to the wearer from friction or bruising caused by excessive movement of the bra. In addition, the present invention is easy to attach or remove and is also washable. The present invention is decorative and can be designed in many colors or shapes to appeal to consumer tastes.

What is claimed is:

1. A shaped protective cushioning structure for attachment to any underwire/no underwire brassiere for protecting a wearer of said brassiere from skin abrasion and/or irritation caused by any component of said brassiere, comprising:

a cantilevered, snap close, two sided multi-prong clip encased within a cushioning structure;

said cantilevered snap close multi-pronged clip including two cantilevered sides having a front side and a back side;

said front side including a single pronged portion;

said back side including a base portion with at least two prongs extending outwardly therefrom;

said front and back side portions snap closed when pressed on one end and snap open when pressed on an opposite end;

said snap close multi-pronged clip being encased by a cushioning structure;

said cushioning structure including a first outer layer of fabric surrounding the front portion of the clip;

a second outer layer of lace deposed about at least a portion of said fabric covering the front of the clip;

a first outer layer of elastic surrounding the base potion of the clip;

a second outer layer of fabric surrounding the elastic layer;

a third outer layer of foam covering the second outer layer of said fabric covering the elastic sandwiched between a fourth outer layer of fabric and a fifth outer layer of lace covering said fourth layer of fabric; and wherein said clip and cushioning structure is placed on a wearer's brassiere in areas of abrasion such as at the exposed underwires or seam areas of the brassiere structure or on any other component of the brassiere structure.

2. A shaped protective cushioning structure for attachment to any underwire/non underwire brassiere for protecting a wearer as claimed in claim 1, and further wherein said cushioning structure is in the shape of any one of a rectangle, heart, circle, butterfly or fruit.

3. A shaped protective cushioning structure for attachment to any underwire/no underwire brassiere for protecting a wearer as claimed in claim 2, and further wherein said clip is constructed from anyone of hard plastics, metal or bendable wire.

4. A shaped protective cushioning structure for attachment to any underwire/no underwire brassiere for protecting a wearer as claimed in claim 1, and further wherein said outer fabric layer selection includes numerous colors.

5. A method of protecting a wearer of an underwire/no underwire brassiere from abrasion from protruding brassiere components including underwires and seams comprising the steps of:

providing a clip-on cushioning structure including a cantilevered, snap close, two sided multi-prong clip encased within a cushioning structure;

said cantilevered snap close multi-pronged clip including two cantilevered sides having a front side and a back side;

said front side including a single pronged portion;

said back side including a base portion with at least two prongs extending outwardly therefrom;

said front and back side portions are curved along their length so that when said front and back sides snap closed when pressed on one end and snap open when pressed on an opposite end;

said snap close multi-pronged clip being encased by a cushioning structure;

said cushioning structure including a first outer layer of fabric surrounding the front portion of the clip;

a second outer layer of lace disposed about at least a portion of said fabric covering the front of the clip;

a first outer layer of elastic surrounding the base of the clip;

a second outer layer of fabric surrounding the elastic layer;

a third outer layer of foam covering the second outer layer of said fabric covering the elastic sandwiched between a fourth outer layer of fabric and a fifth outer layer of lace covering said fourth layer of fabric;

placing said clip and said cushioning structure on a wearer's brassiere inclusive garment in areas of the brassiere garment that can abrade the wearer including areas of exposed underwires or seam areas or on any other abrasive portion of the brassiere inclusive garment; and attaching said cushioning structure to a wearer's brassiere inclusive garment over said abrading area in between the brassiere abrading area and said skin surface of said wearer in order to protect and cushion said wearer's skin surface from said abrading brassiere area.

6. A clip-on brassiere underwire cushioning pad protector comprising:

a shaped cushioning structure including a cantilevered snap close multi-pronged clip including two cantilevered side portions of a front side portion and a back side portion;

said front side portion including a single pronged portion;

said back side portion including a base portion with at least two prongs extending outwardly therefrom;

said front and back side portions snap closed when pressed on one end and snap open when pressed on an opposite end;

said snap close multi-pronged clip being encased by a cushioning structure;

said cushioning structure including a first fabric outer layer surrounding the front portion of the clip;

a second outer decorative material layer disposed about at least a portion of said fabric layer covering the front portion of the clip;

a first outer layer of elastic surrounding the base of the clip back portion;

a second outer layer of fabric surrounding the elastic layer;

a third outer layer of foam covering the second outer layer of said fabric covering the elastic sandwiched between a fourth outer layer of fabric and a fifth layer of decorative material covering said fourth layer of fabric; and wherein said clip and cushioning structure is placed on a wearer's brassiere in areas of abrasion such as at the exposed underwires or seam areas of the brassiere structure or on any other abrasive component of the brassiere structure.

7. A clip-on brassiere underwire cushioning pad protector as claimed in claim 6 and further comprising:

said cushioning structure is in the shape of any one of a rectangle, heart, circle, butterfly or fruit.

8. A clip-on brassiere underwire cushioning pad protector as claimed in claim 6 and further comprising:

said clip is constructed from any one of hard plastics, metal or bendable wire.

9. A clip-on brassiere underwire cushioning pad protector as claimed in claim 6 and further comprising:

said outer fabric layer selection includes fabrics of numerous colors.

10. A clip-on brassiere underwire cushioning pad protector as claimed in claim 6 and further comprising:

said second outer decorative layer is formed of any one of a lace, ribbon or any combination thereof.

11. A clip-on brassiere underwire cushioning pad protector as claimed in claim 6 and further comprising:

said foam layer is a gelatinous material.

12. A clip on brassiere underwire cushioning pad protector as claimed in claim 6 and further comprising:

said foam layer is substituted with any one of a cotton batting, a batting material, or multiple fabric layers as a cushioning layer.

13. A brassiere inclusive garment with or without underwires therein, in combination with a clip-on brassiere cushioning pad protector, comprising:

a brassiere inclusive garment formed of an outer garment layer with a brassiere attached thereunder the outer garment layer and wherein the brassiere is with or without underwires;

a shaped cushioning structure including a cantilevered, snap close, two sided multi-pronged clip encased within cushioning layers;

said cantilevered snap close multi-pronged clip including two cantilevered side portions of a front side and a back side;

said front side portion including a single pronged portion;

said back side portion including a base portion with at least two prongs extending outwardly therefrom;

said front and back side portions snap closed when pressed on one end and snap open when pressed on an opposite end;

said snap close multi-pronged clip being encased by a cushioning structure;

said cushioning structure including a first fabric outer layer surrounding the front side portion of the clip;

a second outer decorative material layer is disposed about said fabric layer covering the front portion of the clip;

a first outer layer of elastic surrounding the base of the back portion of the clip; a second outer layer of fabric surrounding the elastic layer;

a third outer layer of foam covering the second outer layer of said fabric covering the elastic sandwiched between a fourth outer layer of fabric and a fifth layer of decorative material covering said fourth layer of fabric; and wherein said clip and cushioning structure is placed on a wearer's brassiere in areas of abrasion such as at the exposed underwires or seam areas of the brassiere structure or on any other abrasive component of the brassiere structure.

14. A brassiere inclusive garment with or without underwires therein, in combination with a clip-on brassiere cushioning pad protector as claimed in claim 13 and further comprising:

said brassiere inclusive garment with a built-in brassiere.

15. A brassiere inclusive garment with or without underwires therein, in combination with a clip on brassiere cushioning pad protector, as claimed in claim 13 and further comprising:

said cushioning structure is in the shape of any one of a rectangle, heart, circle, butterfly or fruit.

16. A brassiere inclusive garment with or without underwires therein, in combination with a clip on brassiere cushioning pad protector as claimed in claim 13 and further comprising:

wherein said clip is constructed form any one of hard plastics, metal or bendable wire.

17. A brassiere inclusive garment with or without underwires therein, in combination with a clip on brassiere cushioning pad protector as claimed in claim 3 and comprising:

wherein said outer fabric layer selection includes fabrics in numerous colors.

18. A brassiere inclusive garment with or without underwires therein, in combination with a clip on brassiere cushioning pad protector as claimed in claim 13 and further comprising:

said second outer decorative layer is formed from any one of a lace material, ribbon or any combinations thereof.

19. A brassiere inclusive garment with or without underwires therein, in combination with a clip on brassiere cushioning pad protector as claimed in claim 13 and further comprising:

said foam is substituted with any one of a cotton batting, a batting, or multiple fabric layers as the cushioning layer.

20. A brassiere inclusive garment with or without underwires therein, in combination with a clip on brassiere cushioning pad protector, comprising:

wherein said foam layer is a gelatinous material.

21. A shaped protective cushioning structure for attachment to any underwire/no underwire brassiere in any brassiere inclusive garment for protecting a wearer of said brassiere inclusive garment from skin abrasion and/or irritation caused by any component of said brassiere structure in said brassiere or brassiere inclusive garment, comprising:

a cantilevered snap close clip encased within a cushioning structure;

said cantilevered snap close clip having a front side portion and a hack side portion with a base; each of said front side portion and said back side portion is encased in a cushion structure;

the front portion of the clip is surrounded with a first outer layer of fabric;

a first outer layer of elastic surrounds the base of the back side portion of the clip;

a second outer layer of fabric surrounds the elastic layer;

a third outer cushioning layer of any one of a foam, a gelatinous material, a cotton batting, a batting layer or multiple fabric layers covers the second outer layer of said fabric covering the elastic layer of fabric and;

wherein said clip and cushioning structure is placed on a wearer's brassiere in areas of abrasion or irritation such as at the exposed underwires or seam areas of the brassiere structure or at any other desired locations of the brassiere structure that abrade or irritate the wearer.

22. A shaped protective cushioning structure for attachment to any underwire/no underwire brassiere in any brassiere inclusive garment for protecting a wearer of said brassiere inclusive garment from skin abrasion and/or irritation caused by any component of said brassiere structure in said brassiere or brassiere inclusive garment as claimed in claim 21 and further comprising:

wherein said brassiere inclusive garment a garment with a built-in brassiere.

23. A shaped protective cushioning structure for attachment to any underwire/no underwire brassiere in any brassiere inclusive garment for protecting a wearer of said brassiere inclusive garment from skin abrasion and/or irritation caused by any component of said brassiere structure in said brassiere or brassiere inclusive garment as claimed in claim 21 and further comprising:

said cushioning structure is in the shape of any one of a rectangle, heart, circle, butterfly or fruit.

24. A shaped protective cushioning structure for attachment to any underwire/no underwire brassiere in any brassiere inclusive garment for protecting a wearer of said brassiere inclusive garment from skin abrasion and/or irritation caused by any component of said brassiere structure in said brassiere or brassiere inclusive garment as claimed in claim 21 and further comprising:

said clip is constructed from any one of hard plastics, metal or bendable wire.

25. A shaped protective cushioning structure for attachment to any underwire/no underwire brassiere in any brassiere inclusive garment for protecting a wearer of said brassiere inclusive garment from skin abrasion and/or irritation caused by any component of said brassiere structure in said brassiere or brassiere inclusive garment as claimed in claim 21 and further comprising:

said outer fabric layer selection includes fabrics of numerous colors.

26. A shaped protective cushioning structure for attachment to any underwire/no underwire brassiere in any brassiere inclusive garment for protecting a wearer of said brassiere inclusive garment from skin abrasion and/or irritation caused by any component of said brassiere structure in said brassiere or brassiere inclusive garment as claimed in claim 21 and further comprising:

said clip front portion includes additional decorative layers outward of said first outer layer of fabric including any one of lace, ribbon or combinations thereof.

27. A shaped protective cushioning structure for attachment to any underwire/no underwire brassiere in any brassiere inclusive garment for protecting a wearer of said brassiere inclusive garment from skin abrasion and/or irritation caused by any component of said brassiere structure in said brassiere or brassiere inclusive garment as claimed in claim 21 and further comprising:

said clip base portion includes additional decorative layers outward of said third cushioning layers including any one of lace, ribbon or combinations thereof.

* * * * *